US010232279B2

(12) United States Patent
Woolston

(10) Patent No.: US 10,232,279 B2
(45) Date of Patent: Mar. 19, 2019

(54) MODULAR CUBE BUILDING SYSTEM

(71) Applicant: Reginald Frederick Woolston, Bakersfield, CA (US)

(72) Inventor: Reginald Frederick Woolston, Bakersfield, CA (US)

( * ) Notice: Subject to any disclaimer, the term of this patent is extended or adjusted under 35 U.S.C. 154(b) by 0 days.

(21) Appl. No.: 14/975,674

(22) Filed: Dec. 18, 2015

(65) Prior Publication Data

US 2017/0173487 A1 Jun. 22, 2017

(51) Int. Cl.

| | |
|---|---|
| ***A63H 33/08*** | (2006.01) |
| ***A63H 33/04*** | (2006.01) |
| ***A63H 33/06*** | (2006.01) |

(52) U.S. Cl.

CPC ..... *A63H 33/08* (2013.01); *A63H 33/04* (2013.01); *A63H 33/06* (2013.01)

(58) Field of Classification Search

CPC ..... A63H 33/04; A63H 33/044; A63H 33/06; A63H 33/062; A63H 33/065; A63H 33/08; A63H 33/084; A63H 33/086; A63H 33/088; A63H 33/10

See application file for complete search history.

(56) References Cited

U.S. PATENT DOCUMENTS

| | | | | | |
|---|---|---|---|---|---|
| 2,013,771 | A * | 9/1935 | Tompkins | A63H 33/062 | 24/595.1 |
| 2,810,233 | A * | 10/1957 | Jakobsen | A63H 33/088 | 446/126 |
| 2,861,388 | A * | 11/1958 | Favaretto | A63H 33/088 | 446/119 |
| 4,306,373 | A * | 12/1981 | Chatani | A63H 33/088 | 446/121 |
| 4,602,908 | A * | 7/1986 | Kroeber | A63H 33/088 | 446/124 |
| 5,647,181 | A * | 7/1997 | Hunts | A63H 33/10 | 312/111 |
| 2003/0013374 | A1* | 1/2003 | Lin | A63H 33/04 | 446/85 |
| 2007/0130874 | A1* | 6/2007 | Teng-Fu | A47B 96/1408 | 52/633 |
| 2008/0207082 | A1* | 8/2008 | Warner | A63H 33/108 | 446/111 |
| 2015/0174502 | A1* | 6/2015 | Saigo | A63H 33/086 | 446/124 |
| 2016/0310861 | A1* | 10/2016 | Hirata | A61F 13/327 | |

* cited by examiner

*Primary Examiner* — Gene Kim
*Assistant Examiner* — Alyssa Hylinski
(74) *Attorney, Agent, or Firm* — Muskin and Farmer LLC

(57) ABSTRACT

A modular building block system and method. A set of pieces are formed with interlocking pegs and holes allowing the creation of structures. One such structure that can be made is a cube which can be attached using the pegs and holes to identically formed cubes. The cubes have panels of which custom artwork can be printed on them, thereby enabling complex scenes to be created using only the cubes.

16 Claims, 12 Drawing Sheets

MODULAR CUBE BUILDING SYSTEM

BACKGROUND OF THE INVENTION

Field of the Invention

The present general inventive concept is directed to a method and apparatus to construct a cube and a set of joined cubes for use as a toy or display.

Description of the Related Art

Toy building blocks such as LEGO are blocks with a pattern which can snap onto each other, thereby allowing the user to construct a variety of objects. However, LEGO blocks have drawbacks which render them disadvantageous when building certain structures such as cubes.

SUMMARY OF THE INVENTION

It is an aspect of the present invention to provide an advantageous building block system.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
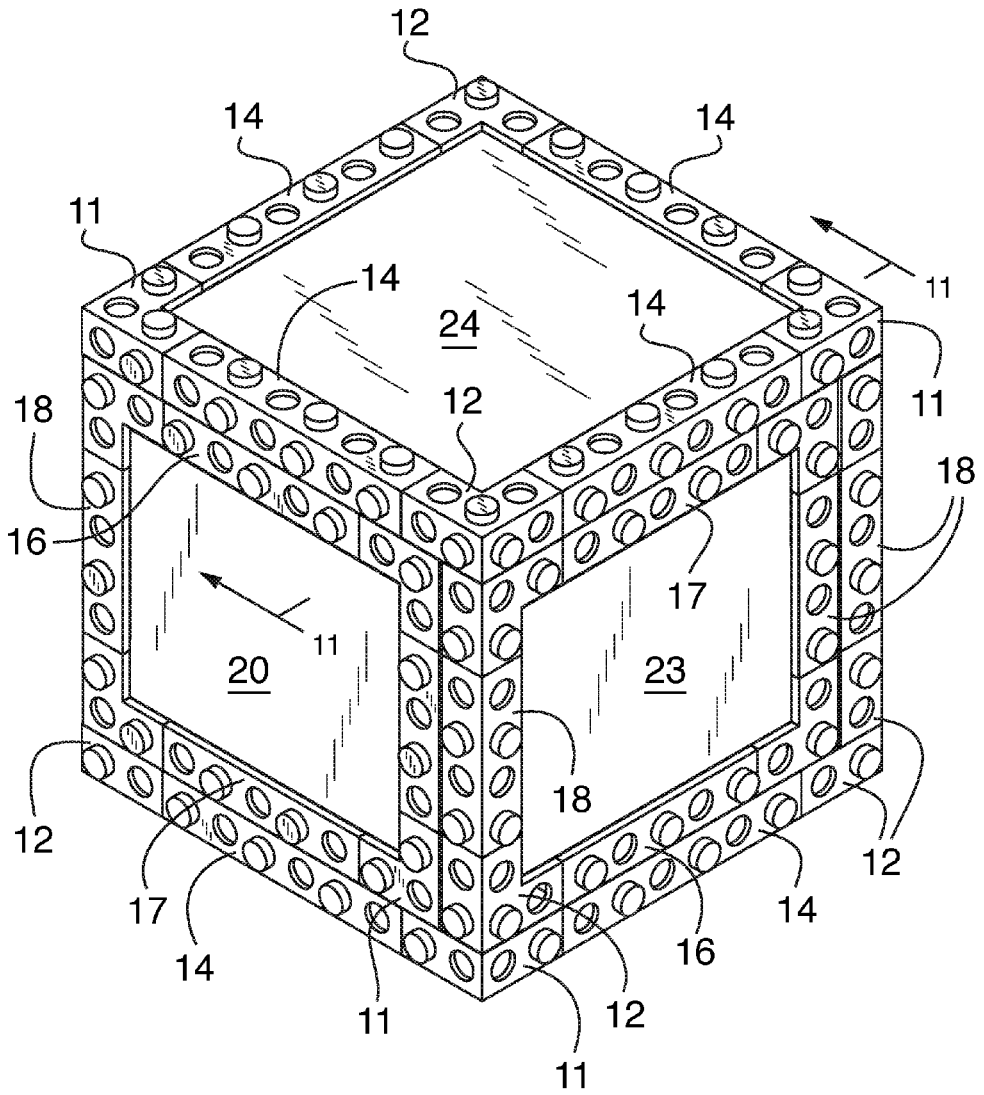
FIG. 1 is an isometric drawing of a cube, according to an embodiment.

Reference will now be made in detail to the presently preferred embodiments of the invention, examples of which are illustrated in the accompanying drawings, wherein like reference numerals refer to like elements throughout.

The present inventive concept relates to a set of building blocks and how the building blocks are joined together to form a cube. Once a cube of the present invention is formed, it can then be joined to another cube by pressing the cubes together (thereby causing the cooperative parts to join). In this manner, a large number of such cubes can be joined together in a number of different patterns. Each cube can have different panels with different designs on them, thus a large number of cubes can cause a complex pattern to be displayed. Thus, different scenes can be created, such as a farm, city block, spaceship, or practically anything can be modelled by printing customized panels and assembling the cubes in the proper configuration.

FIG. 1 is an isometric drawing of a cube, according to an embodiment.

An assembled cube is shown, with a top panel 24, a first side panel 20, a second side panel 23, a plurality of first elbow pieces 12, second elbow pieces 11, large side pieces 14, first medium side pieces 16, second medium side pieces 17, and small side pieces 18.

Note that the pieces (first elbow pieces 12, second elbow pieces 11, large side pieces 14, first medium side pieces 16, second medium side pieces 17, and small side pieces 18) can all be made in numerous ways. For example, they can be 3-D printed, injection molded, carved, etc. They can be made out of plastic, rubber, wood, metal, ceramic, or any suitable material. If the pieces are 3-D printed then any suitable material can be used for 3-D printing such as ABS, PLA, nylon (or polyamide), stainless steel, etc. The pieces are made such that they "cooperate" with each other, that is, adjacent pieces in the assembled cube will fit (snap) into each other so that the pegs will fit into the corresponding holes on the adjacent piece.

Note that all of the different types of pieces would come in a kit in which the user would assemble on his own. Each of the different types of pieces are identical to each other (subject any minor difference to do manufacturing variations, etc.)

Figure 2A:
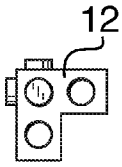
FIG. 2A is a drawing of a side view of a first elbow piece, according to an embodiment.

FIG. 2A is a drawing of a side view of a first elbow piece, according to an embodiment. Note that the first elbow pieces are "elbow shaped" at a right angle. In other words, a first shaft of the first elbow piece and a second shaft of the first elbow piece are joined at right angles.

Figure 2B:
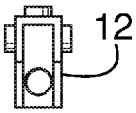
FIG. 2B is a drawing of an end view of the first elbow piece, according to an embodiment.

FIG. 2B is a drawing of an end view of the first elbow piece, according to an embodiment.

Figure 2C:
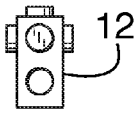
FIG. 2C is a drawing of a rear view of the first elbow piece, according to an embodiment.

FIG. 2C is a drawing of a rear view of the first elbow piece, according to an embodiment.

Figure 2D:
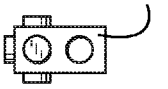
FIG. 2D is a drawing of a top view of the first elbow piece, according to an embodiment.

FIG. 2D is a drawing of a top view of the first elbow piece, according to an embodiment.

Figure 2E:
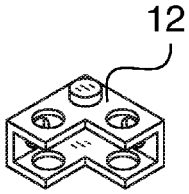
FIG. 2E is an isometric drawing of the first elbow piece, according to an embodiment.

FIG. 2E is an isometric drawing of the first elbow piece, according to an embodiment.

Note that the first elbow piece and the second elbow piece are identical but for one difference, that is the holes and pegs in the first elbow piece are in an opposite configuration to the holes and pegs in the second elbow piece. Opposite configuration means wherever there is a hole in one there is a peg in the other and wherever there is a peg in one there is a hole in the other.

Figure 3A:
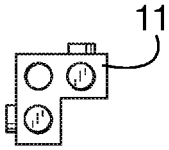
FIG. 3A is a drawing of a side view of a second elbow piece, according to an embodiment.

FIG. 3A is a drawing of a side view of a second elbow piece, according to an embodiment. Note that the second elbow pieces are "elbow shaped" at a right angle. In other words, a first shaft of the second elbow piece and a second shaft of the second elbow piece are joined at right angles.

Figure 3B:
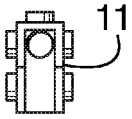
FIG. 3B is a drawing of an end view of the second elbow piece, according to an embodiment.

FIG. 3B is a drawing of an end view of the second elbow piece, according to an embodiment.

Figure 3C:
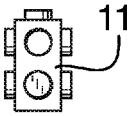
FIG. 3C is a drawing of a rear view of the second elbow piece, according to an embodiment.

FIG. 3C is a drawing of a rear view of the second elbow piece, according to an embodiment.

Figure 3D:
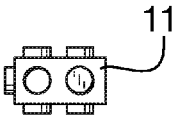
FIG. 3D is a drawing of a top view of the second elbow piece, according to an embodiment.

FIG. 3D is a drawing of a top view of the second elbow piece, according to an embodiment.

Figure 3E:
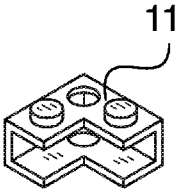
FIG. 3E is an isometric drawing of the second elbow piece, according to an embodiment.

FIG. 3E is an isometric drawing of the second elbow piece, according to an embodiment.

Figure 4A:
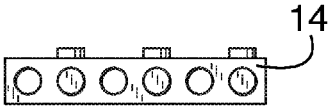
FIG. 4A is a drawing of a side view of a large side piece, according to an embodiment.

FIG. 4A is a drawing of a side view of a large side piece, according to an embodiment.

Figure 4B:
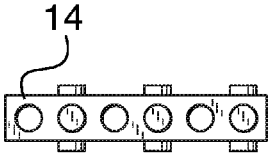
FIG. 4B is a drawing of an end view of the large side piece, according to an embodiment.

FIG. 4B is a drawing of an end view of the large side piece, according to an embodiment.

Figure 4C:
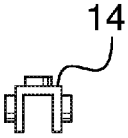
FIG. 4C is a drawing of a rear view of the large side piece, according to an embodiment.

FIG. 4C is a drawing of a rear view of the large side piece, according to an embodiment.

Figure 4D:
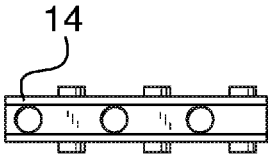
FIG. 4D is a drawing of a top view of the large side piece, according to an embodiment.

FIG. 4D is a drawing of a top view of the large side piece, according to an embodiment.

Figure 4E:
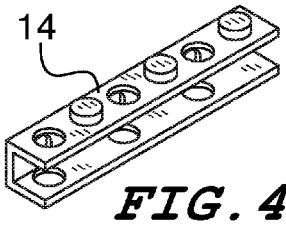
FIG. 4E is an isometric drawing of the large side piece, according to an embodiment.

FIG. 4E is an isometric drawing of the large side piece, according to an embodiment.

Figure 5A:
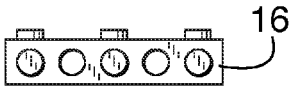
FIG. 5A is a drawing of a side view of a first medium side piece, according to an embodiment.

FIG. 5A is a drawing of a side view of a first medium side piece, according to an embodiment.

Figure 5B:
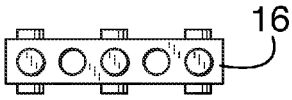
FIG. 5B is a drawing of an end view of the first medium side piece, according to an embodiment.

FIG. 5B is a drawing of an end view of the first medium side piece, according to an embodiment.

Figure 5C:
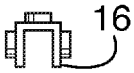
FIG. 5C is a drawing of a rear view of the first medium side piece, according to an embodiment.

FIG. 5C is a drawing of a rear view of the first medium side piece, according to an embodiment.

Figure 5D:
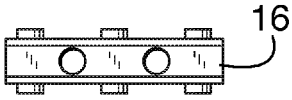
FIG. 5D is a drawing of a top view of the first medium side piece, according to an embodiment.

FIG. 5D is a drawing of a top view of the first medium side piece, according to an embodiment.

Figure 5E:
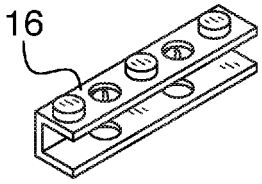
FIG. 5E is an isometric drawing of the first medium side piece, according to an embodiment.

FIG. 5E is an isometric drawing of the first medium side piece, according to an embodiment.

Figure 6A:
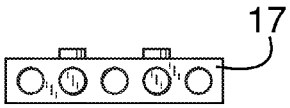
FIG. 6A is a drawing of a side view of a second medium side piece, according to an embodiment.

FIG. 6A is a drawing of a side view of a second medium side piece, according to an embodiment.

Figure 6B:
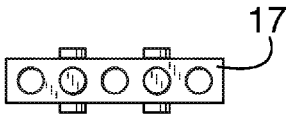
FIG. 6B is a drawing of an end view of the second medium side piece, according to an embodiment.

FIG. 6B is a drawing of an end view of the second medium side piece, according to an embodiment.

Figure 6C:
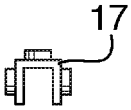
FIG. 6C is a drawing of a rear view of the second medium side piece, according to an embodiment.

FIG. 6C is a drawing of a rear view of the second medium side piece, according to an embodiment.

Figure 6D:
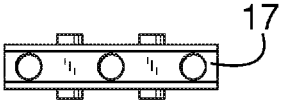
FIG. 6D is a drawing of a top view of the second medium side piece, according to an embodiment.

FIG. 6D is a drawing of a top view of the second medium side piece, according to an embodiment.

Figure 6E:
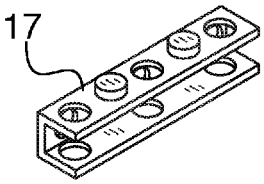
FIG. 6E is an isometric drawing of the second medium side piece, according to an embodiment.

FIG. 6E is an isometric drawing of the second medium side piece, according to an embodiment.

Note that the first medium side piece and the second medium side piece are identical but for one difference, that is the holes and pegs in the first medium side piece are in an opposite configuration to the holes and pegs in the second medium side piece.

Figure 7A:
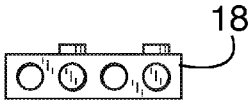
FIG. 7A is a drawing of a side view of a small side piece, according to an embodiment.

FIG. 7A is a drawing of a side view of a small side piece, according to an embodiment.

Figure 7B:
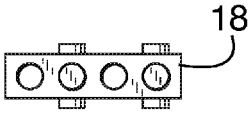
FIG. 7B is a drawing of an end view of the small side piece, according to an embodiment.

FIG. 7B is a drawing of an end view of the small side piece, according to an embodiment.

Figure 7C:
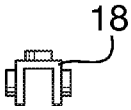
FIG. 7C is a drawing of a rear view of the small side piece, according to an embodiment.

FIG. 7C is a drawing of a rear view of the small side piece, according to an embodiment.

Figure 7D:
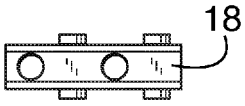
FIG. 7D is a drawing of a top view of the small side piece, according to an embodiment.

FIG. 7D is a drawing of a top view of the small side piece, according to an embodiment.

Figure 7E:
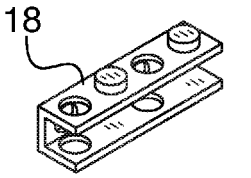
FIG. 7E is an isometric drawing of the small side piece, according to an embodiment.

FIG. 7E is an isometric drawing of the small side piece, according to an embodiment.

Top panel 24, side panel 20, side panel 21, side panel 22, side panel 23, bottom panel 26, can be made out of any flat material that can be printed on (e.g., thick paper, cardboard, plastic, wood, foam, etc.) The panels can have the custom printed designs/artwork directly printed on them so that when a plurality of cubes are placed in the right configuration, a designed scene can be created (e.g., an appearance of a place or object). The panels will also have sufficient thickness to fit snugly inside their respective pieces that surround them.

Figure 8:
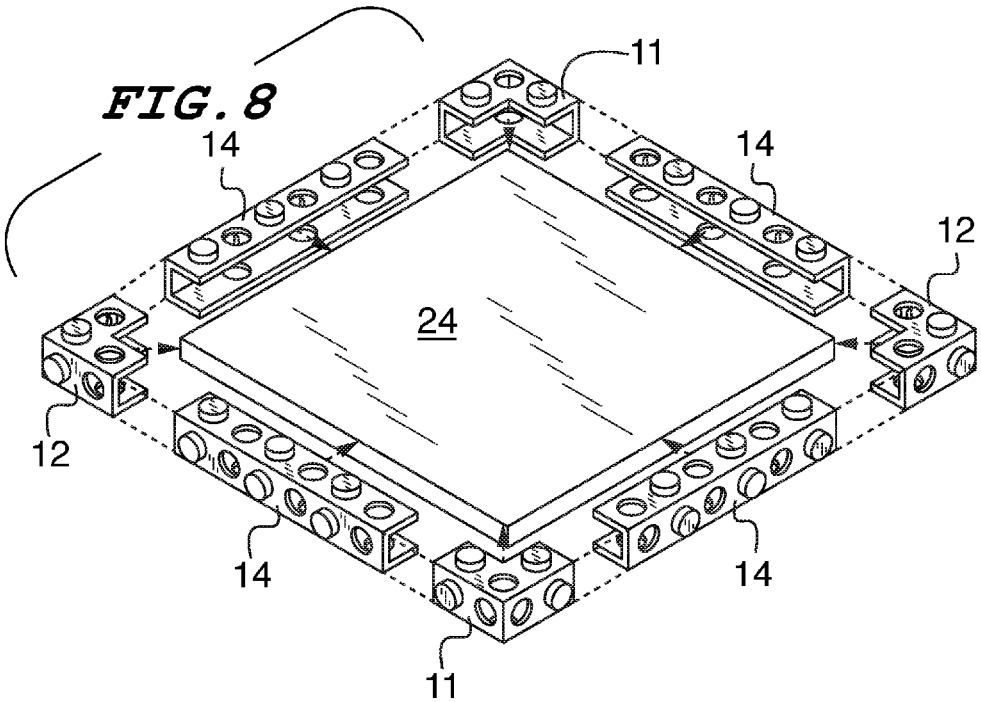
FIG. 8 is an exploded isometric drawing showing assembly of a top or end panel, according to an embodiment.

FIG. 8 is an exploded isometric drawing showing assembly of a top or end panel, according to an embodiment.

First elbow pieces 12, second elbow pieces 11 and large side pieces 14 are all pressed onto the perimeter of top panel 24. The thickness of top panel 24 is sufficient to fit snugly inside all of these pieces. Once assembled, the fit is snug enough such that the entire top assembly (the top panel 24 and all of its surrounding pieces shown in FIG. 8) will stay together. Note that the bottom assembly is constructed similarly (using the same pieces with the bottom panel 26).

Note that there are two types of elbow pieces (first elbow pieces 12 and second elbow pieces 11) and that in the top assembly identical elbow pieces are catacorner to each other. In other words a first elbow piece 12 is opposite a first elbow piece 12 along a line dividing the top panel in equal parts, and a second elbow piece 11 is opposite a second elbow piece 11 along a line dividing the top panel in equal parts. The bottom assembly can be the same way. In another embodiment, the opposite elbow pieces can be different along a line dividing the panel (top and/or bottom) in equal parts can be different (not the same type of elbow piece but the other kind of elbow piece).

Figure 9:
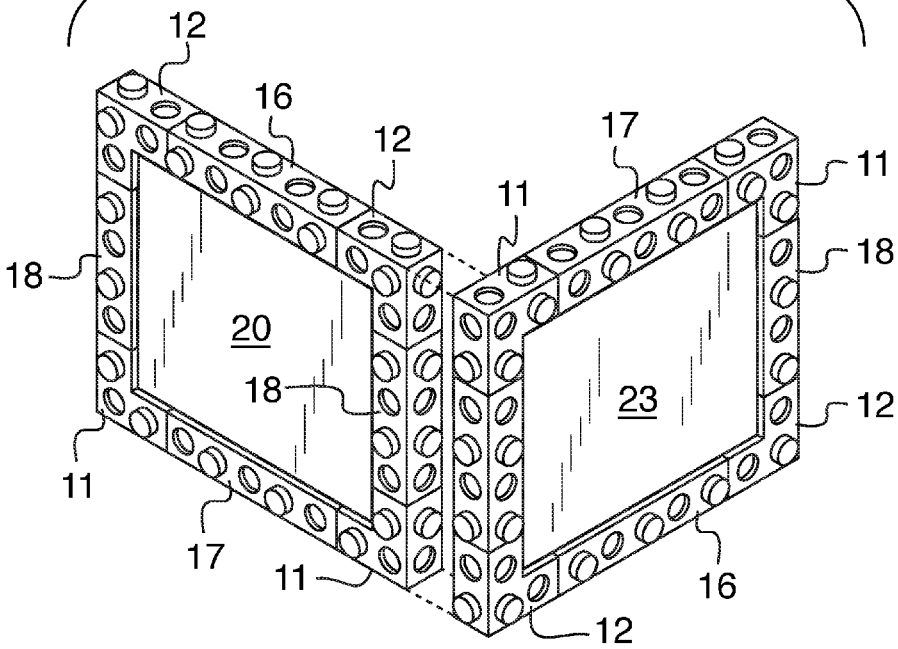
FIG. 9 is an exploded isometric drawing showing two assembled side pieces being assembled to form two sides of a cube, according to an embodiment.

FIG. 9 is an exploded isometric drawing showing two assembled side pieces being assembled to form two sides of a cube, according to an embodiment. The holes and pegs of the different sides are pressed together to connect the sides as shown in FIG. 9. All sides and the top and bottom are connected similarly to form the cube.

First elbow pieces 12, second elbow pieces 11, the first medium side piece 16, the second medium side piece 17, and two small side pieces 18 are all pressed onto side panel 20 as illustrated to form a first side assembly. First elbow pieces 12, second elbow pieces 11, the first medium side piece 16, the second medium side piece 17, and two small side pieces 18 are all pressed onto side panel 23 as illustrated to form a second side assembly. All four sides are constructed in the same way using their respective side panels.

Figure 10:
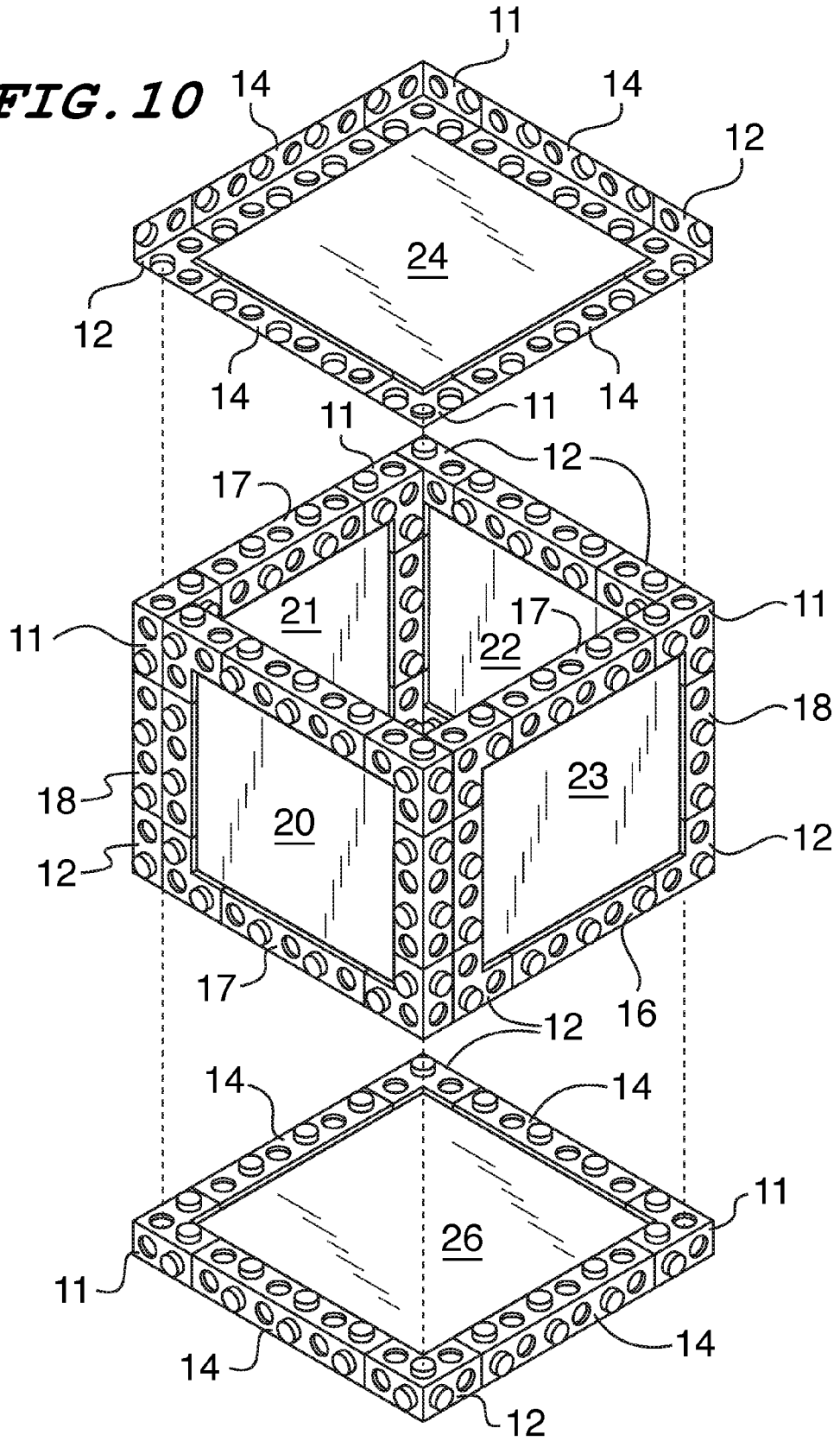
FIG. 10 is an exploded isometric drawing of four assembled side panels and two assembled end panels being assembled to form a cube, according to an embodiment.

FIG. 10 is an exploded isometric drawing of four assembled side panels and two assembled end panels being assembled to form a cube, according to an embodiment.

First elbow pieces 12, second elbow pieces 11, the first medium side piece 16, the second medium side piece 17, and two small side pieces 18 are all pressed onto side panel 21 as illustrated to form a third side assembly. First elbow pieces 12, second elbow pieces 11, the first medium side piece 16, the second medium side piece 17, and two small side pieces 18 are all pressed onto side panel 22 as illustrated to form a fourth side assembly.

First elbow pieces 12, second elbow pieces 11 and large side pieces 14 are all pressed onto the perimeter of bottom panel 26 to form a bottom assembly.

The first side assembly (comprising side panel 20) is attached to the third side assembly (comprising side panel 21), and the second side assembly (comprising side panel 23) in the manner shown. The fourth side assembly (comprising side panel 22) is attached to the second side assembly (comprising side panel 23) and the third side panel assembly (comprising side panel 21) in the manner shown.

The top assembly (comprising top panel 24) is connected to the first side assembly, the second side assembly, the third side assembly and the fourth side assembly in the manner shown. The bottom assembly (comprising bottom panel 26) is connected to the first side assembly, the second side assembly, the third side assembly, and the fourth side assembly in the manner shown.

Note that opposite elbow pieces in each side assembly are different (non-identical) elbow pieces. In another embodiment, opposite elbow pieces can be identical.

Note that top panel 24 and bottom panel 26 are both end panels and are typically identical in structure (but not necessarily appearance as unique designs can be printed on them). Note that the four side panels 20, 21, 22, 23 are also typically identical in structure (but not necessarily appearance as unique designs can be printed on them).

Note that all pieces that are pressed into each other are designed to cooperate, that is all pegs will fit the corresponding holes in the adjacent piece and all holes will fit their corresponding pegs in the adjacent piece. The fit will be snug such that once assembled, the pieces will stay together without the need for any type of adhesive. However, with reasonable manual force, the pieces can still be pulled apart and separated from each other.

The top assembly would require two first elbow pieces 12, two second elbow pieces 11, and four large side pieces 14. The bottom assembly would also require two first elbow pieces 12, two second elbow pieces 11, and four large side pieces 14. Each side assembly would require two first elbow pieces 12, two second elbow pieces 11, a first medium side piece 16, a second medium side piece 17, and two small side pieces 18. To construct an entire cube would require the top assembly, the bottom assembly, and four side assemblies, which would all be pushed together (in the manner illustrated) to connect all of the assemblies to form the cube. Thus, the entire cube would require 12 first elbow pieces, 12 second elbow pieces, 8 large side pieces 14, 4 first medium side pieces 16, 4 second medium side pieces 17, and 8 small side pieces 18. A kit could come with these quantities of pieces to create exactly one cube although of course a kit could have enough pieces to construct many cubes (e.g., 2 to 100 or more).

Note that each cube also requires two end panels (the top panel and the bottom panel are end panels) and four side panels. The end panels and side panels fit inside the pieces as illustrated in the Figures. The kit can come with the top panels and side panels. In an embodiment a user can print overlays on a standard printer (along with any desired patterns, colors, or designs) using standard party. The user can place the overlays over the end panels and side panels before inserting into the pieces. In this way, the overlays are visible on the cube so each cube can have a customized appearance on all six sides (of course surfaces that may not be visible such as the bottom would not need an overlay).

Figure 11:
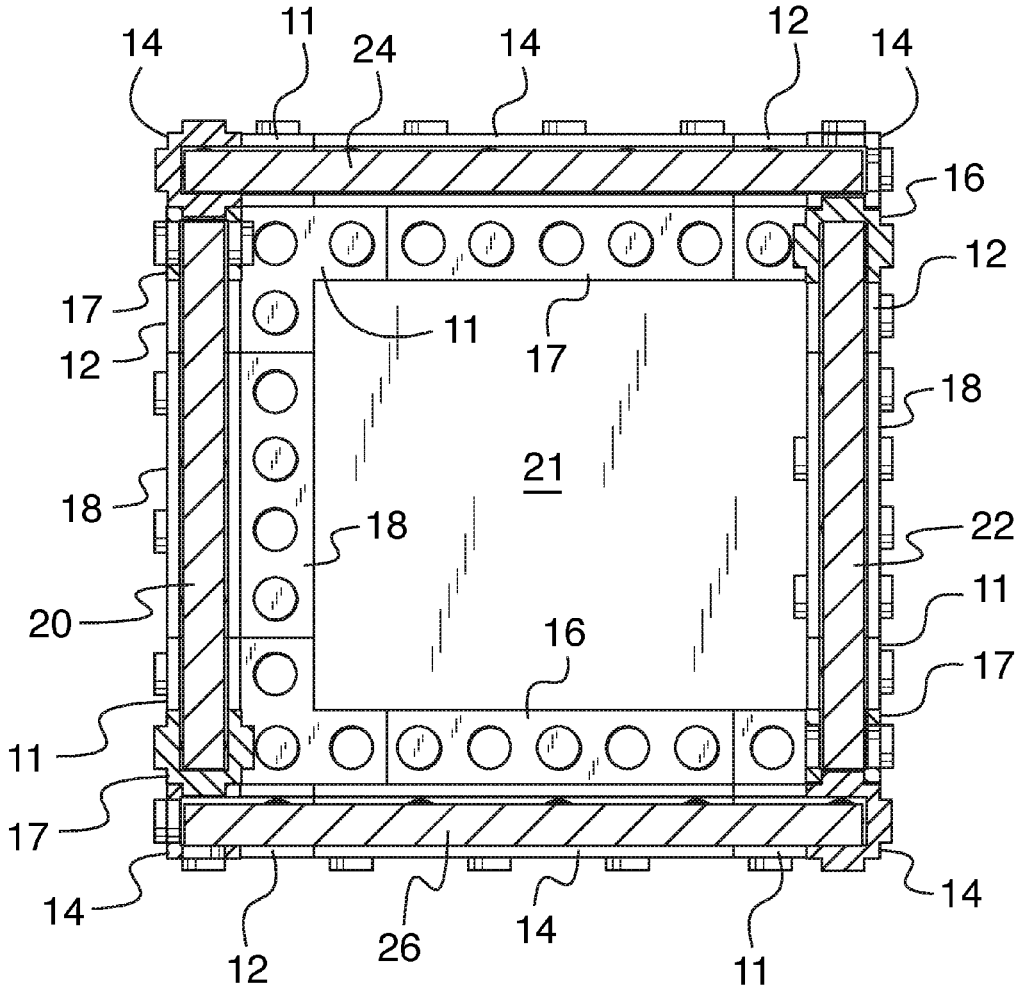
FIG. 11 is a drawing of a cross-sectional view as indicated in FIG. 1, according to an embodiment.

FIG. 11 is a drawing of a cross-sectional view as indicated in FIG. 1, according to an embodiment.

Figure 12:
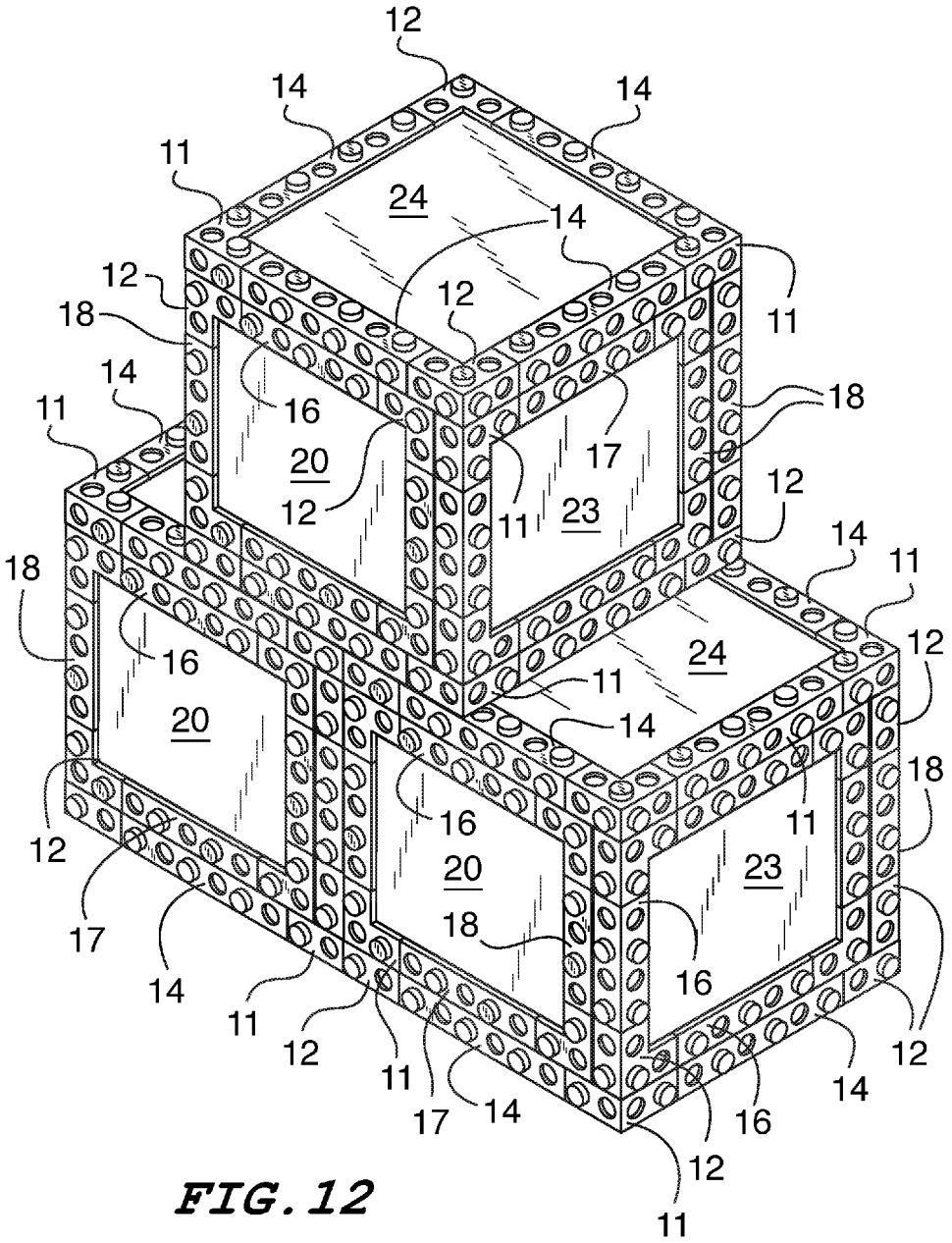
FIG. 12 is a drawing of three identical cubes connected together, according to an embodiment.

FIG. 12 is a drawing of three identical cubes connected together, according to an embodiment.

Note that pegs and holes of different cubes fit together to cooperate in order to allow different cubes to fit snugly together when pressed together. In this manner, a large and tall structure made of such cubes should be stable and not fall down. While not all pegs and holes are visible in FIG. 12, the pegs and holes of adjacent surfaces of different cubes are pushed together to fit.

Figure 13:
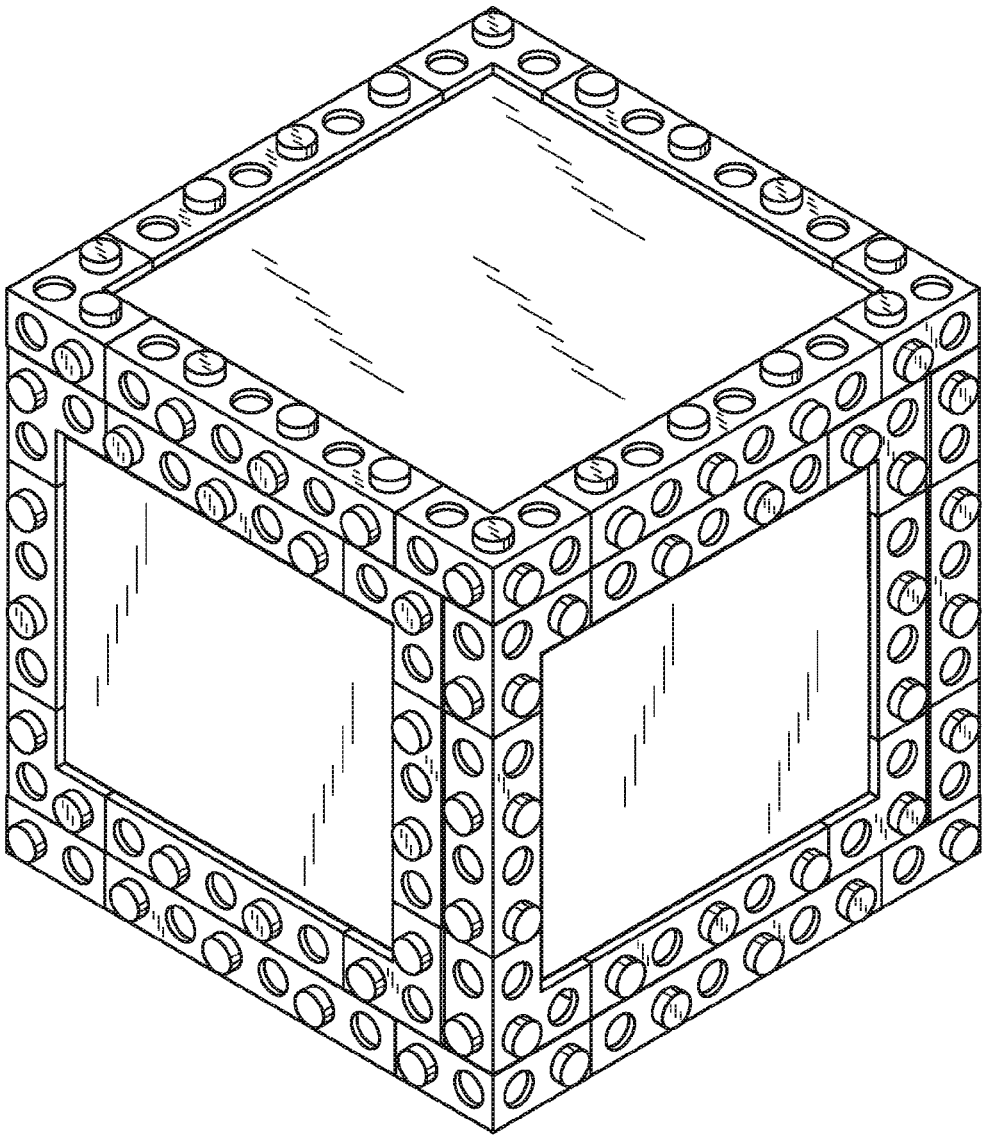
FIG. 13 is an exploded isometric drawing from the top or one end of the cube, according to an embodiment.

FIG. 13 is an exploded isometric drawing from the top or one end of the cube, according to an embodiment.

Figure 14:
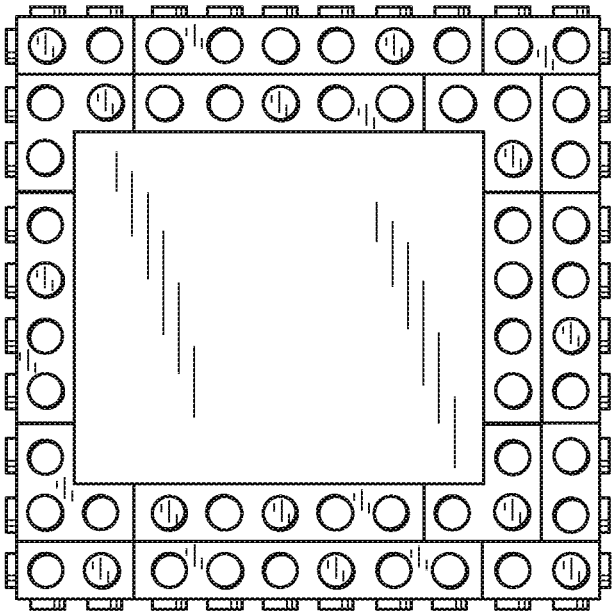
FIG. 14 is drawing of a side view of the cube, according to an embodiment.

FIG. 14 is a drawing of a side view of the cube, according to an embodiment.

Figure 15:
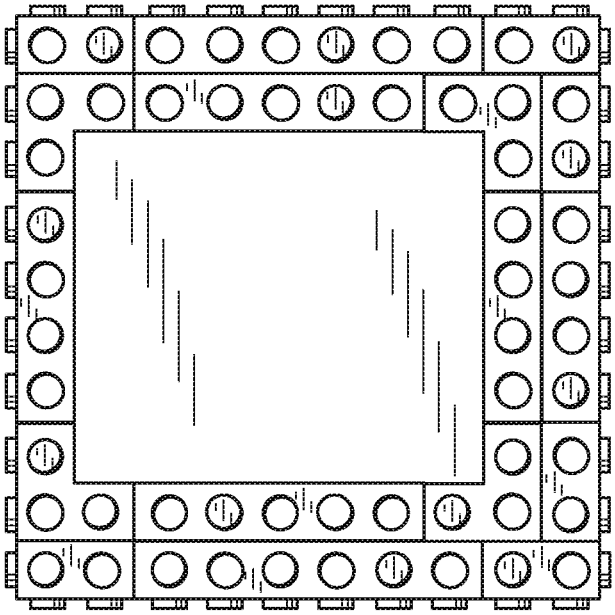
FIG. 15 is a drawing of an opposite side view of the cube, according to an embodiment.

FIG. 15 is a drawing of an opposite side view of the cube, according to an embodiment.

Figure 16:
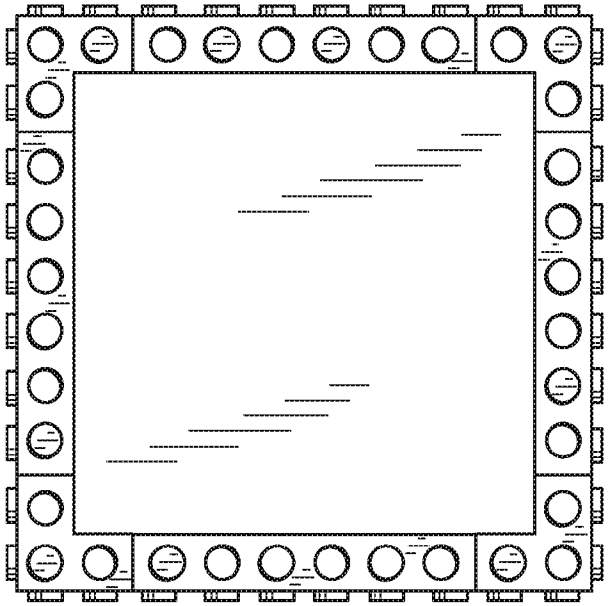
FIG. 16 is a drawing of a top or one end view of the cube, according to an embodiment.

FIG. 16 is a drawing of a top or one end view of the cube, according to an embodiment.

Figure 17:
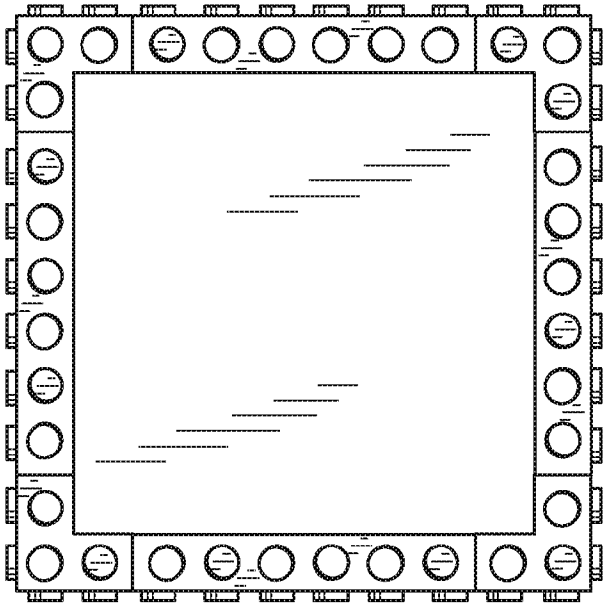
FIG. 17 is a drawing of a bottom or opposite end view of the cube, according to an embodiment.

FIG. 17 is a drawing of a bottom or opposite end view of the cube, according to an embodiment.

Figure 18:
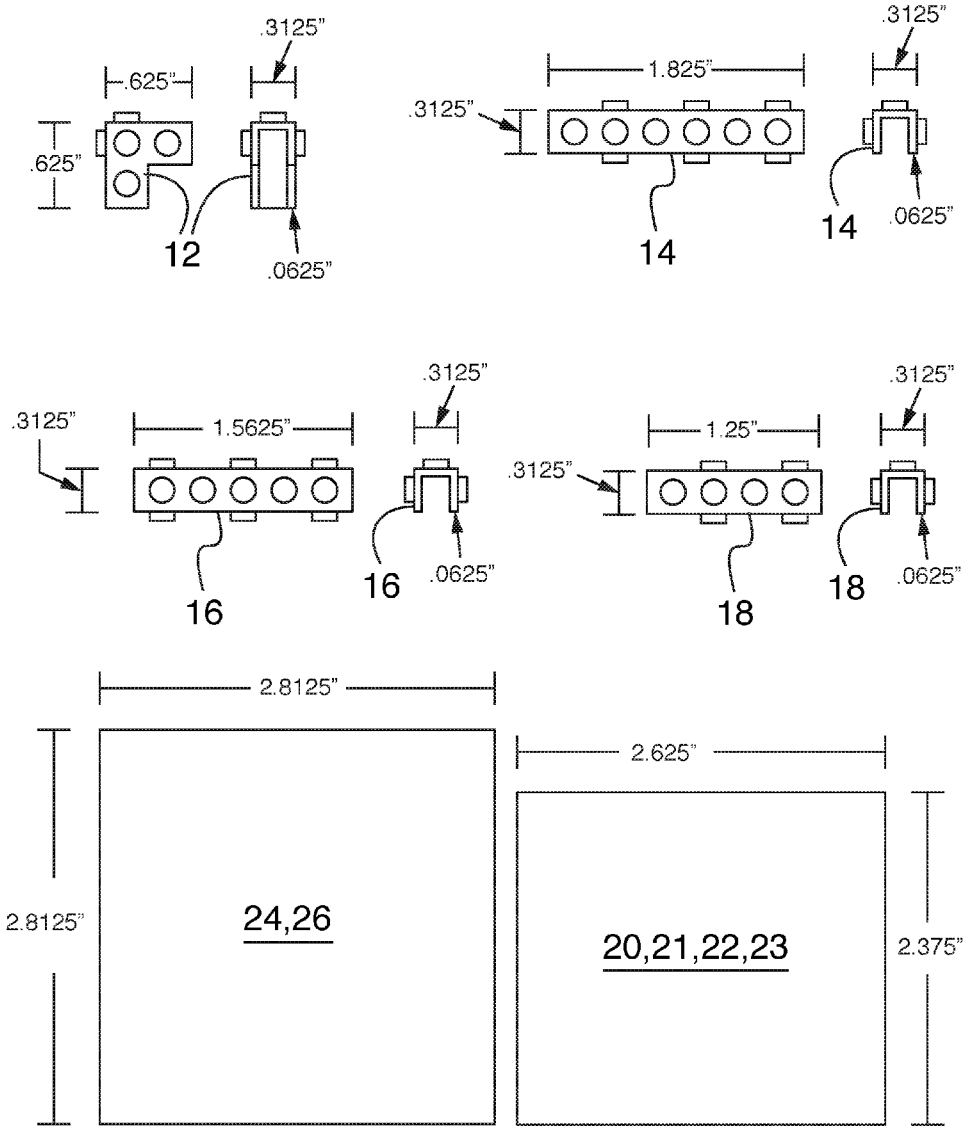
FIG. 18 is a drawing of the panels and the pieces showing a possible set of measurements, according to an embodiment.

FIG. 18 is a drawing of the panels and the pieces showing a possible set of measurements, according to an embodiment.

The cube described herein (and hence its pieces) can come in almost any sizes. However one possible set of measurements is shown in FIG. 18. Note that second elbow piece 11 would have the same measurements as first elbow piece 12, and that first medium side pieces 16 would have the same measurements as second medium side piece 17. Note that the invention is not limited to the sizes/measurements shown.

Note also that the end panel (meaning the top panel 24 and bottom panel 26) size is larger than the side panel size. All end panels are equal in size and all side panels (i.e. first side, second side, third side, fourth side) are equal in size.

Figure 19:
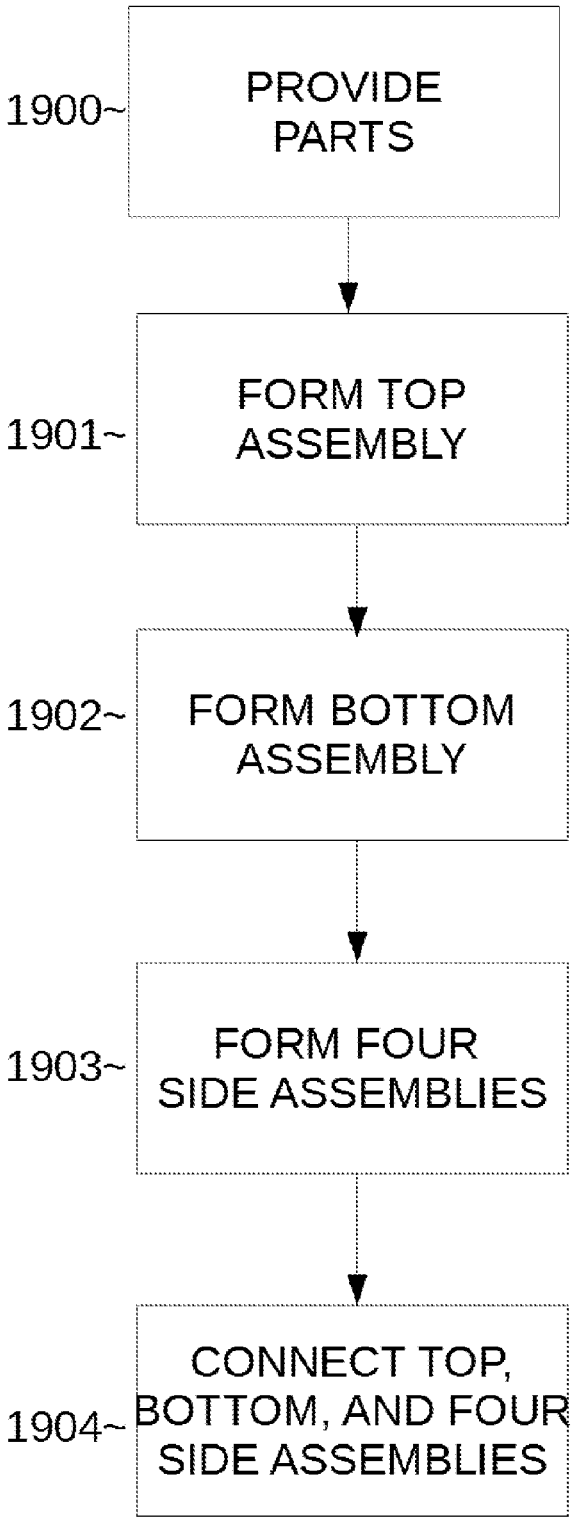
FIG. 19 is a flowchart illustrating a method of constructing a cube, according to an embodiment.

FIG. 19 is a flowchart illustrating a method of constructing a cube, according to an embodiment.

The method can begin with operation 1900, which provides the parts used for the other operations. The parts can be purchased in a kit, 3-D printed, molded, etc.

From operation 1900, the method proceeds to operation 1901, wherein the top assembly is constructed using the parts as described herein. See FIG. 8 and the accompanying description.

From operation 1901, the method proceeds to operation 1902, wherein the bottom assembly is constructed using the parts as described herein. See FIG. 8 and the accompanying description.

From operation 1902, the method proceeds to operation 1903, wherein the four side assemblies are constructed using the parts as described herein. See FIG. 9.

From operation 1903, the method proceeds to operation 1904, wherein the top assembly, bottom assembly, and four side assemblies are all joined together to form a cube. All of the assemblies can be joined together by pressing their corresponding edges together thereby utilizing the pegs and holes to form a friction fit. See FIG. 10.

Note that the operations in FIG. 19 can be performed in any order. Note that there is no limit to the number of cubes that can be constructed using the embodiments described herein and these cubes can all be joined together in unlimited ways to create an unlimited number of displays. Cubes can be stacked vertically to create multiple levels, and any type of 3-D shapes and scenes can be made using the cubes, such as skyscrapers, pyramids, etc. The panels (or inserts over the panels) of each cube would have appropriate designs printed on them corresponding to the exact position and orientation of the cube in the scene in order to make the scene. Scenes can be made out of a very large number of cubes, such as hundreds, thousands, etc.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An apparatus, comprising:

a plurality of first elbow pieces, the first elbow pieces are elbow shaped at a right angle, each of the first elbow pieces comprising pegs and holes;

a plurality of second elbow pieces, the second elbow pieces are elbow shaped at a right angle, each of the second elbow pieces comprising pegs and holes;

a plurality of large side pieces, each of the large side pieces comprising pegs and holes;

a plurality of first medium side pieces, each of the first medium side pieces comprising pegs and holes, each of the first medium side pieces being smaller in length than each of the large side pieces;

a plurality of second medium side pieces, each of the second medium side pieces comprising pegs and holes, each of the second medium side pieces being identical in length to each of the first medium side pieces; and a plurality of small side pieces, each of the small side pieces comprising pegs and holes, each of the small side pieces being smaller in length than each of the first medium side pieces, wherein twelve of the plurality of first elbow pieces, twelve of the plurality of second elbow pieces, eight of the plurality of large side pieces, four of the plurality first medium side pieces, four of the plurality of second medium side pieces, and eight of the plurality of small side pieces are connected together to form a first cube.

2. The apparatus as recited in claim 1, wherein the first elbow pieces are identical to the second elbow pieces but for the first elbow pieces have pegs and holes in an opposite configuration to the second elbow pieces.

3. The apparatus as recited in claim 1, wherein the first medium side pieces are identical to the second medium side pieces but for the first medium side pieces have pegs and holes in an opposite configuration to the second medium side pieces.

4. The apparatus as recited in claim 1, further comprising an end panel.

5. The apparatus as recited in claim 4, further comprising a side panel, smaller in length and width than the end panel.

6. The apparatus as recited in claim 1, wherein the first cube further comprises two end panels and 4 side panels.

7. The apparatus as recited in claim 1, further comprising a second cube comprising of twelve first elbow pieces, twelve second elbow pieces, eight large side pieces, four first medium side pieces, four second medium side pieces, and eight small side pieces connected together, wherein the first cube is connected to the second cube using respective pegs and holes on adjoining pieces connecting the first cube and the second cube.

8. An apparatus, comprising:

a top panel; and a top assembly comprising two top first elbow pieces being shaped at a right angle comprising pegs and holes in corners on the top panel, two top second elbow pieces being elbow shaped at right angles comprising pegs and holes in corners on the top panel, and four top large side pieces comprising pegs and holes on sides of the top panel;

a first side panel; and a first side assembly comprising two first side first elbow pieces being shaped at a right angle comprising pegs and holes in corners on the first side panel, two first side second elbow pieces being elbow shaped at right angles comprising pegs and holes in corners on the first side panel, two first side small side pieces comprising pegs and holes on opposite sides of the first side panel, a first side first medium side piece comprising pegs and holes and a first side second medium side piece comprising pegs and holes, the first side first medium side piece and the first side second medium side piece being on opposite sides of the first side panel.

9. The apparatus as recited in claim 8, further comprising:

a bottom panel; and a bottom assembly comprising two bottom first elbow pieces being shaped at a right angle comprising pegs and holes in corners on the bottom panel, two bottom second elbow pieces being elbow shaped at right angles comprising pegs and holes in corners on the bottom panel, and four bottom large side pieces comprising pegs and holes on sides of the bottom panel.

10. The apparatus as recited in claim 9, further comprising:

a second side panel; and a second side assembly comprising two second side first elbow pieces being shaped at a right angle comprising pegs and holes in corners on the second side panel, two second side second elbow pieces being elbow shaped at right angles comprising pegs and holes in corners on the second side panel, two second side small side pieces comprising pegs and holes on opposite sides of the second side panel, a second side first medium side piece comprising pegs and holes and a second side second medium side piece comprising pegs and holes, the second side first medium side piece and the second side second medium side piece being on opposite sides of the second side panel;

a third side panel;

a third side assembly comprising two third side first elbow pieces being shaped at a right angle comprising pegs and holes in corners on the third side panel, two third side second elbow pieces being elbow shaped at right angles comprising pegs and holes in corners on the third side panel, two third side small side pieces comprising pegs and holes on opposite sides of the third side panel, a third side first medium side piece comprising pegs and holes and a third side second medium side piece comprising pegs and holes, the third side first medium side piece and the third side second medium side piece being on opposite sides of the third side panel;

a fourth side panel;

a fourth side assembly comprising two fourth side first elbow pieces being shaped at a right angle comprising pegs and holes in corners on the fourth side panel, two fourth side second elbow pieces being elbow shaped at right angles comprising pegs and holes in corners on the fourth side panel, two fourth side small side pieces comprising pegs and holes on opposite sides of the fourth side panel, a fourth side first medium side piece comprising pegs and holes and a fourth side second medium side piece comprising pegs and holes, the fourth side first medium side piece and the fourth side second medium side piece being on opposite sides of the fourth side panel, wherein the top assembly, bottom assembly, first side assembly, second side assembly, third side assembly, and fourth side assembly are all connected using respective pegs and holes forming a cube.

11. The apparatus as recited in claim 8, wherein the top first elbow pieces are identical to the top second elbow pieces but for the top first elbow pieces have pegs and holes in an opposite configuration to the top second elbow pieces.

12. The apparatus as recited in claim 9, wherein the top first elbow pieces are identical to the top second elbow pieces but for the top first elbow pieces have pegs and holes in an opposite configuration to the top second elbow pieces, wherein the bottom first elbow pieces are identical to the bottom second elbow pieces but for the bottom first elbow pieces have pegs and holes in an opposite configuration to the bottom second elbow pieces.

13. The apparatus as recited in claim 8, wherein the first side first medium side piece and the first side second medium side piece are identical but for being in an opposite configuration.

14. The apparatus as recited in claim 10, wherein the first side first medium side piece and the first side second medium side piece are identical but for being in an opposite configuration, wherein the second side first medium side piece and the second side second medium side piece are identical but for being in an opposite configuration, wherein the third side first medium side piece and the third side second medium side piece are identical but for being in an opposite configuration, wherein the fourth side first medium side piece and the fourth side second medium side piece are identical but for being in an opposite configuration.

15. A method, comprising:

providing:

eight first elbow pieces, the first elbow pieces are elbow shaped at a right angle, each of the first elbow pieces comprising pegs and holes;

eight second elbow pieces, the second elbow pieces are elbow shaped at a right angle, each of the second elbow pieces comprising pegs and holes;

eight large side pieces, each of the large side pieces comprising pegs and holes;

a top panel;

a bottom panel;

a first side panel;

two first side first elbow pieces, the first side first elbow pieces are elbow shaped at a right angle, each of the first side first elbow pieces comprising pegs and holes;

two first side second elbow pieces, the first side second elbow pieces are elbow shaped at a right angle, each of the first side second elbow pieces comprising pegs and holes;

a first side first medium side piece comprising pegs and holes and being smaller in length than each of the large side pieces;

a first side second medium side piece comprising pegs and holes and being identical in length to the first side first medium side piece;

two first side small side pieces comprising pegs and holes, each of the first side small side pieces being smaller in length than the first side first medium side piece;

forming a top assembly by placing two first elbow pieces and two second elbow pieces on corners of the top panel and using four large side pieces to fill in spaces between the first elbow pieces and the second elbow pieces on the top panel; and forming a bottom assembly by placing two first elbow pieces and two second elbow pieces on corners of the bottom panel, and using four large side pieces to fill in spaces between the first elbow pieces and the second elbow pieces on the bottom panel; and forming a first side assembly by placing two first side first elbow pieces and two first side second elbow pieces on corners of the first side panel, placing the first side small side pieces on opposite sides of the first side panel, and placing the first side first medium side piece and the first side second medium side piece on opposite sides of the first side panel.

16. The method as recited in claim 15, further comprising:

further providing:

a second side panel, third side panel, a fourth side panel;

two second side first elbow pieces, the second side first elbow pieces are elbow shaped at a right angle, each of the second side first elbow pieces comprising pegs and holes;

two second side second elbow pieces, the second side second elbow pieces are elbow shaped at a right angle, each of the second side second elbow pieces comprising pegs and holes;

a second side first medium side piece comprising pegs and holes and being smaller in length than each of the large side pieces;

a second side second medium side piece comprising pegs and holes and being identical in length to the second side first medium side piece;

two second side small side pieces comprising pegs and holes, each of the second side small side pieces being smaller in length than the second side first medium side piece;

two third side first elbow pieces, the third side first elbow pieces are elbow shaped at a right angle, each of the third side first elbow pieces comprising pegs and holes;

two third side second elbow pieces, the third side second elbow pieces are elbow shaped at a right angle, each of the third side second elbow pieces comprising pegs and holes;

a third side first medium side piece comprising pegs and holes and being smaller in length than each of the large side pieces;

a third side second medium side piece comprising pegs and holes and being identical in length to the third side first medium side piece;

two third side small side pieces comprising pegs and holes, each of the third side small side pieces being smaller in length than the third side first medium side piece;

two fourth side first elbow pieces, the fourth side first elbow pieces are elbow shaped at a right angle, each of the fourth side first elbow pieces comprising pegs and holes; two fourth side second elbow pieces, the fourth side second elbow pieces are elbow shaped at a right angle, each of the fourth side second elbow pieces comprising pegs and holes;

a fourth side first medium side piece comprising pegs and holes and being smaller in length than each of the large side pieces; a fourth side second medium side piece comprising pegs and holes and being identical in length to the fourth side first medium side piece;

two fourth side small side pieces comprising pegs and holes, each of the fourth side small side pieces being smaller in length than the fourth side first medium side piece;

forming a second side assembly by placing two second side first elbow pieces and two second side second elbow pieces on corners of the second side panel, placing the second side small side pieces on opposite sides of the second side panel, and placing the second side first medium side piece and the second side second medium side piece on opposite sides of the second side panel;

forming a third side assembly by placing two third side first elbow pieces and two third side second elbow pieces on corners of the third side panel, placing the third side small side pieces on opposite sides of the third side panel, and placing the third side first medium side piece and the third side second medium side piece on opposite sides of the third side panel;

forming a fourth side assembly by placing two fourth side first elbow pieces and two fourth side second elbow pieces on corners of the fourth side panel, placing the fourth side small side pieces on opposite sides of the fourth side panel, and placing the fourth side first medium side piece and the fourth side second medium side piece on opposite sides of the fourth side panel; and forming a cube by connecting the top assembly, the bottom assembly, the first side assembly, the second side assembly, the third side assembly, and the fourth side assembly.

* * * * *